US007140418B2

(12) United States Patent
Botham et al.

(10) Patent No.: US 7,140,418 B2
(45) Date of Patent: Nov. 28, 2006

(54) METHOD AND DEVICE FOR THE EVACUATION OF CASTING WASTES

(75) Inventors: Brian W. Botham, Retford (GB); Andrea De Luca, Remanzacco (IT); Edi Faggiani, Udine (IT); Alfredo Poloni, Fogliano Redipuglia (IT); Nuredin Kapaj, Udine (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 161 days.

(21) Appl. No.: 10/520,577

(22) PCT Filed: Jul. 10, 2003

(86) PCT No.: PCT/EP03/07489

§ 371 (c)(1),
(2), (4) Date: Jan. 7, 2005

(87) PCT Pub. No.: WO2004/007115

PCT Pub. Date: Jan. 22, 2004

(65) Prior Publication Data

US 2005/0258213 A1 Nov. 24, 2005

(30) Foreign Application Priority Data

Jul. 10, 2002 (IT) ..... MI2002A1511

(51) Int. Cl.
*B22D 11/06* (2006.01)

(52) U.S. Cl. ..... 164/480; 164/428; 164/5

(58) Field of Classification Search ..... 164/428, 164/480, 5

See application file for complete search history.

(56) References Cited

U.S. PATENT DOCUMENTS

| | | | | |
|---|---|---|---|---|
| 3,344,847 | A | 10/1967 | Beemer | |
| 3,495,651 | A | 2/1970 | Rokop et al. | |
| 3,860,061 | A | 1/1975 | Hoyer | |
| 4,509,578 | A * | 4/1985 | Shaw | 164/155.5 |
| 5,056,583 | A * | 10/1991 | Morii et al. | 164/453 |
| 5,791,398 | A * | 8/1998 | Ono et al. | 164/306 |

FOREIGN PATENT DOCUMENTS

| | | |
|---|---|---|
| DE | 1 083 023 | 6/1960 |
| FR | 2.161.821 | 7/1973 |
| FR | 2.207.768 | 6/1974 |
| WO | 01/39914 | 6/2001 |

* cited by examiner

*Primary Examiner*—Kuang Y. Lin
(74) *Attorney, Agent, or Firm*—Sampson & Associates, P.C.

(57) ABSTRACT

A continuous metallic strip casting plant comprising an ingot mould, a device for the evacuation of casting wastes formed by a trolley which can host two chests. The trolley is located below the ingot mould and on the trolley is deposited the full chest in the free space next to the spare empty chest. The trolley is then moved and the spare empty chest is fixed under the ingot mould. A metal waste evacuation method is also described.

7 Claims, 3 Drawing Sheets

METHOD AND DEVICE FOR THE EVACUATION OF CASTING WASTES

This application claims priority to PCT/EP2003/007489 entitled A Method and Device for the Evacuation of Casting Wastes, filed on 10 Jul. 2003, which claims priority to Italian Patent Application No. MI2002A001511, filed on 10 Jul. 2002.

FIELD OF THE INVENTION

The present invention relates to a method and a device for the evacuation of casting wastes from a continuous metallic strip casting plant.

STATE OF THE ART

Metallic strips are normally produced starting from continuously cast ingots or slabs, which are reduced in thickness by a series of successive operations comprising preforging, hot and cold lamination, together with additional intermediate treatments, for example thermal ones. This operating method involves very expensive plant and notable expenditure of energy.

Hence, for some time the tendency is that of reducing the equipment and business costs by casting products with thickness as close as possible to these of the final product; consequently, following the introduction of continuous slab casting, the thickness of the latter is reduced from the conventional 200–300 mm to 60–100 mm obtained in the so-called thin slab casting (thin slab casting). However, even the passage from 60 mm to 2–3 mm (the typical thickness of a hot strip) requires a series of energetically taxing steps.

In view of the inherent disadvantages in casting bodies of significant thickness for reduction to thin strips, the inherent advantages in directly casting metallic strips have been recognised since the second half of the 19th century, when Sir Thomas Bessemer developed a machine for the continuous casting of steel strip consisting of cooled, counter-rotating metallic rolls set a small distance apart; the metal is cast in the space between the rolls, solidified upon contact with the cold surfaces of the latter and finally extracted with a thickness equal to the distance between the facing surfaces of the rolls themselves.

Such extremely attractive technology has found practical uses for the casting of metals such as copper and aluminium only in the last decades of the 20th century, whilst for high smelting point metals and alloys, such as steel, at present the real industrial spread of such technology is still not manifest.

Numerous efforts are made in this field essentially to reduce production costs, the energy consumed and the environmental impact, and to produce thin strips usable directly just like they are, in particular applications in which for example surface quality is not a particular requirement, or to be considered the same as hot laminated strips for these uses in which thickness' of less than a millimetre are necessary.

Being established that the machine conceived by Bessemer in his time is still, in its general form, the most ideal for continuous metallic strip casting, the problems to be solved for its effective use are very numerous and range from ensuring the tightness of the rolls at their flat ends, to the most suitable materials to survive the demanding working conditions, to the automated control of all the operations and the casting speed and drawing of the strip, up to its winding into a coil.

A plant engineering problem is concerned with the removal of casting wastes. Such casting wastes are produced for example at the beginning of casting, when a strip end of insufficient quality is formed, which cannot be sent to the next phases of the process, but needs to be cut and discarded, or during emergencies in which, for example, the casting rolls forming the ingot mould are moved away from each other to drain the liquid steel contained between the casting rolls.

In the casting line, downstream from the casting rolls the strip is bent and made to continue horizontally on working and treating rolls. This area, substantially below the curve, and vertically below the casting rolls, is that generally destined to a collection system of metal wastes to be eliminated or reused. The collection system generally comprises a chest coated with refractory materials, into which both the strip ends or the liquid steel loads can be allowed to fall.

With an appropriate design it is possible to realise the casting process with effectively continuous functioning, and in which the interrupting steps are very limited or completely absent. Even with such a hypothesis, the wastes must however be removed.

In some situations, it can happen that the waste chest tends to fill up relatively quickly and, since it cannot be constructed over certain limits in size for reasons of overall dimensions, it must be emptied or changed. The chest replacement must be carried out quickly.

A scope of the present invention is providing a device and a method, for removing wastes below an ingot mould in a continuous casting plant, which solves the problems of the state of the art discussed above, by ensuring the presence of waste collection systems at all times during the working of the casting line, with no risk of relatively long intervals in which a collection system is not available.

SUMMARY OF THE INVENTION

It is therefore an object of the present invention to solve the above mentioned problems by creating a continuous metallic strip casting plant which, in accordance with claim 1, comprises an ingot mould, a device for the evacuation of casting wastes comprising in its turn a trolley supplied with at least one chest to contain wastes and metallic scrap, suitable to move and to be positioned below said ingot mould, wherein said trolley has dimensions such as to house at least two chests next to each other.

According to a further aspect of the present invention said problems are solved with a metallic waste evacuation method from a continuous strip casting plant by means of the above described device, the method comprising the following steps:

a) filling a first chest of waste, fixed to an aperture in the lower part of an inert chamber located beneath the ingot mould of said casting line;

b) positioning a first seat for chests of a trolley vertically underneath said first chest, said first seat being free, and a second housing of said trolley being occupied by a second chest;

c) depositing said first chest with appropriate means of loading/unloading into said free housing of said trolley;

d) moving said trolley so as to arrange said second chest underneath said aperture of the lower part of the inert chamber;

e) gripping said second chest with said appropriate means of loading/unloading and raising it to said aperture in the lower part of the inert chamber.

The method also preferably comprises the removal of the trolley with the first chest full of waste for further waste treatment.

Thanks to the waste elimination method, the plant presents a much higher yield, because in a few seconds the changeover of the full chest with an empty one takes place and the first can be quickly removed from the area of the ingot mould. Furthermore, allowing the rapid closure of the inert chamber, i.e. a chamber in which an inert gas based atmosphere is maintained, during the changeover of the chest, the dispersion of gases into the outside atmosphere are very much limited, which improves the economy of the running of the plant.

LIST OF THE FIGURES

Further available advantages with the present finding are more evident, to the expert in the field, from the following detailed description of an example of a particular non-limiting embodiment with reference to the following figures, in which FIG. 1 shows, schematically and in front view, the lifting device for a waste evacuation device for a continuous casting plant according to a preferred embodiment of the present invention;

DETAILED DESCRIPTIOIN

Figure 2:
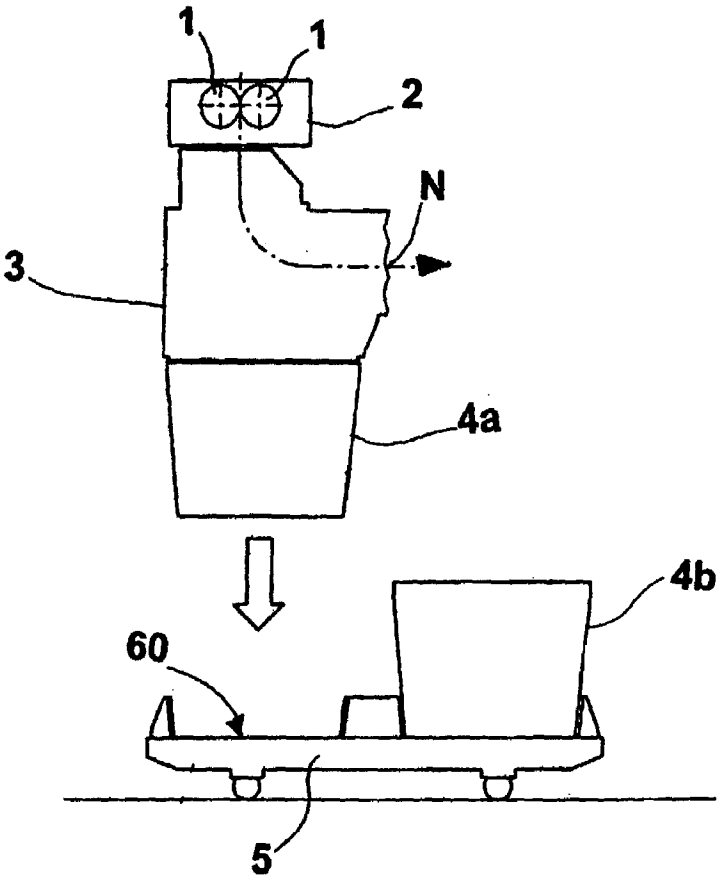
FIG. 2 shows, schematically and in side view, a first stage of the working cycle, of unloading of a chest, of the device in FIG. 1.
Figure 1:
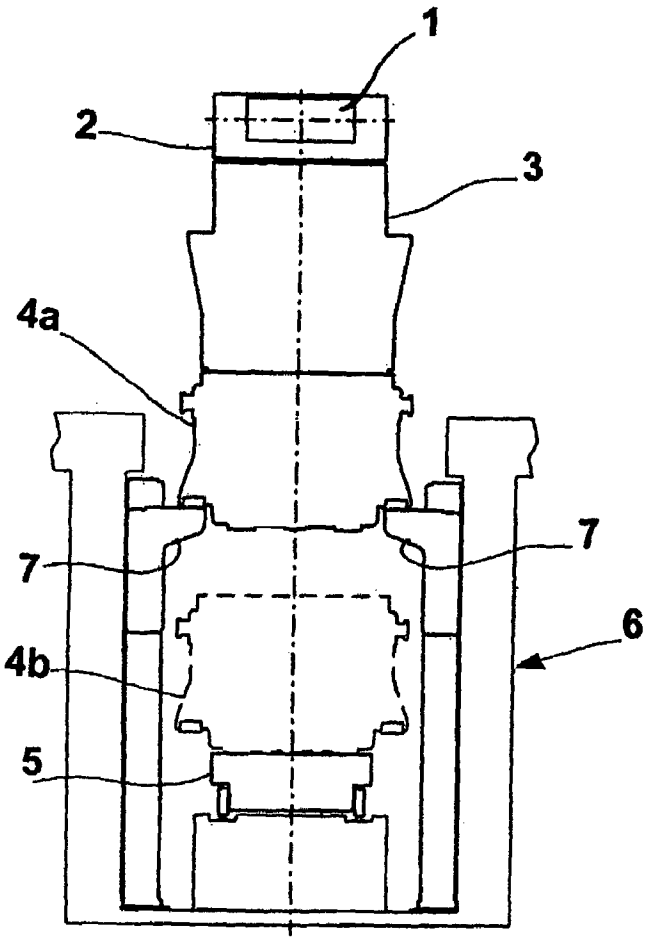

FIGS. 1 and 2 show schematically a front view and a side view of an example of a preferred embodiment of a device for the evacuation of wastes according to the present invention.

A pair of counter-rotating rolls 1, contained in an ingot mould 2, produce a cast in the form of a strip N, according to a procedure of continuous casting, known per se.

The cast strip N follows a curved path inside the inert chamber 3, constituted of a chamber in refractory materials which encloses an atmosphere of inert gas with low oxygen content in its interior. The feeding direction of the casting is deviated, and from vertical—upon exit from the counter-rotating rolls—becomes horizontal upon exit from the inert chamber 3.

The inert chamber 3 is opened at its lower part, and the chest 4*a* is pushed against its lower edge, into which the casting wastes are made to fall from the area below the ingot mould 2.

The waste chest 4*a* can be built for example as a container with the walls coated in refractory materials; the edges of the waste chest 4*a* and of the inert chamber 3 during the working of the continuous casting regime are kept pressing one against the other so as to form a tight closure which isolates the internal atmosphere of the inert chamber 3, low in oxygen, from the outside atmosphere. Appropriate purging phases of the chamber 3 with inert gas can be advantageously envisaged in the starting phases and on changing the chests. Preferably, means 9 to introduce inert gas into the chamber 3 are envisaged, preferably close to the lower aperture. They can advantageously enter into function during the chest changeover steps. The waste chest 4*a* is transported vertically underneath the ingot mould and the initial casting axis by a trolley 5, running on rails, or in general on adequate means of motion.

The waste chest 4*a* is directly raised and lowered from and towards the loading platform, or the seat of the trolley 5, with the lifting system 6, which comprises lifting arms 7 worked, for example, by a system of chains and electric motors, not shown in the figures.

Advantageously, the raising and lowering route of the chests for the wastes 4*a* follows a vertical trajectory and the lifting arms maintain the chests in the operating position, until proceeding to the following changeover. Alternatively other blocking systems can be envisaged, which can also exist in addition to the arms 7, to be used in the case of emergency.

Preferably, the plant is sized such that a chest 4*a* adjacent to the inert chamber 3 is raised completely above the obstacles at the height of the chests 4*b* resting on the trolley 5 and, with advancement of the trolley 4*b*, there are no collisions or interference between the chest 4*a* hitting against the inert chamber 3 and the chest 4*b*, when the latter is removed from the plant.

Preferably, each trolley 5 is made so as to be provided with seats for two or more chests 4*a*, 4*b*, so that they can carry simultaneously at least two or more of them. Preferably the trolley can move in a direction perpendicular to the axis of the rolls of the ingot mould, even if it possible to adopt other solutions.

We will now describe the working of the plant shown in FIGS. 1–5.

Figure 3:
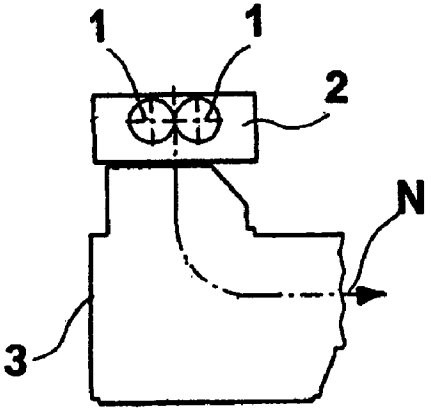
Figure 3:
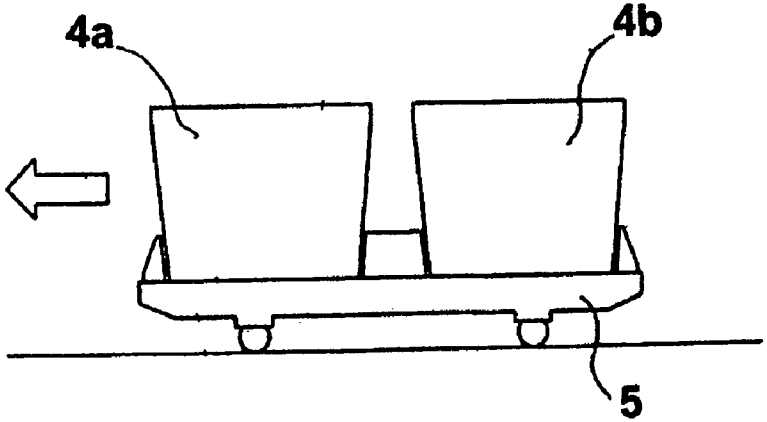

FIG. 2 shows a moment of the unloading phase of a waste chest 4*a* full of wastes, and still fixed to the inert chamber 3: the trolley 5 is positioned with its free seat 60 vertically below the chest 4*a* to be emptied; the arms 7, supporting the chest 4*a* with a downwards movement, lay it down in the free position 60 on the loading platform of the trolley 5. Successively, as shown in FIG. 3, the trolley 5 runs on its wheels towards the left of the drawing, until the second chest 4*b*, empty, already set on the trolley 5, is positioned under the open bottom of the inert chamber 3.

Figure 4:
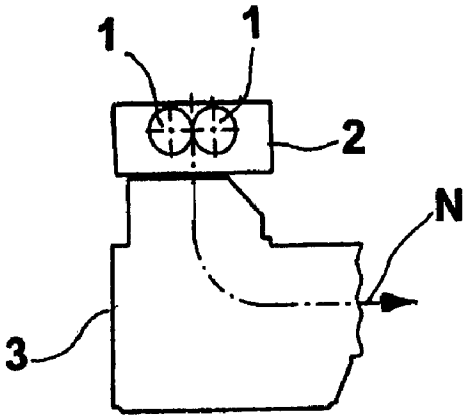
FIGS. 3 and 4 show, schematically and in side view, two successive stages of the working cycle of the device in FIG. 1.
Figure 4:
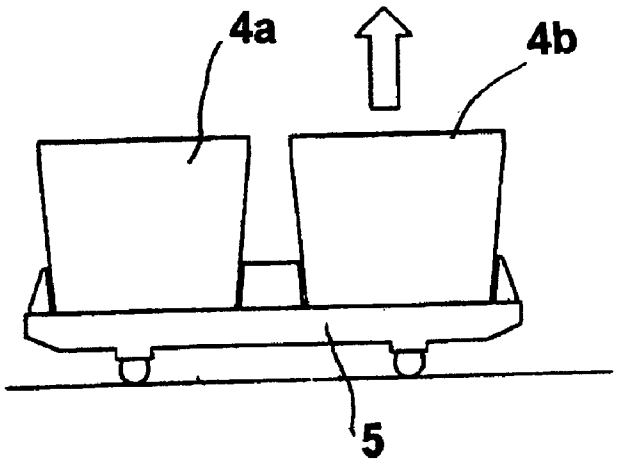
Figure 5:
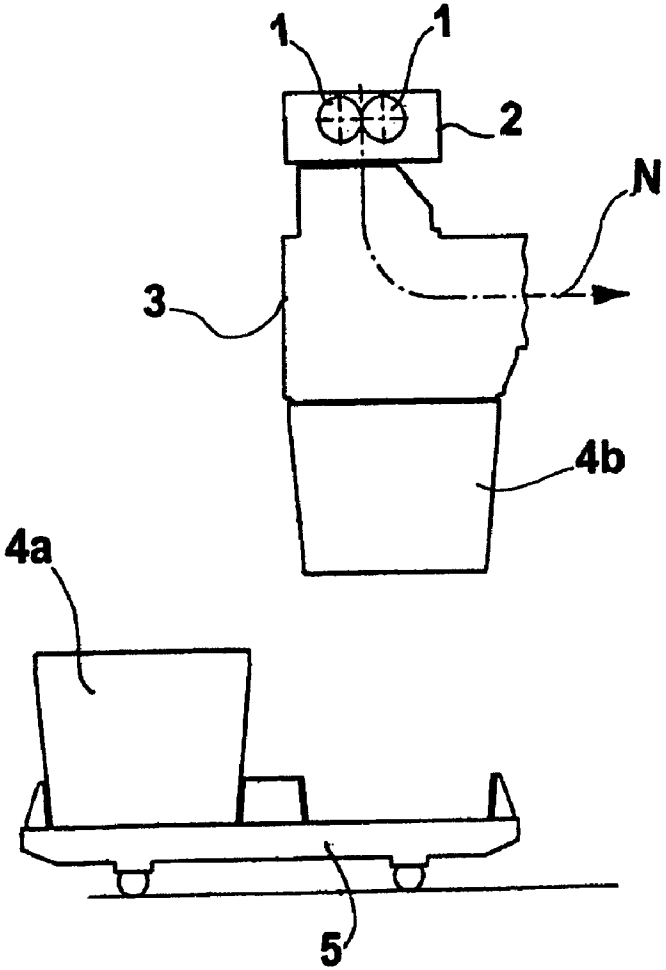
FIG. 5 shows, schematically and in side view, a fourth stage of loading of the chest, of the working cycle of the device in FIG. 1.

The trolley 5 is now set as in FIG. 4. Successively, the mechanical arms 7 engage with appropriate parts of the empty chest 4*b* and raise it bringing it to abutting with the edges of the inert chamber 3 as shown in FIG. 5.

At this point the inert chamber 3 and the new chest 4*b* define once again a tightly isolated environment with respect to the outside atmosphere, and can be kept filled with a controlled atmosphere, for example low in oxygen. The metallic strip casting process proceeds without the need for interruption. The trolley 5 with the chest 4*a* full of wastes is removed for further usage or unloaded of the wastes and the replacement of the chest 4*a* takes place with an empty chest.

Advantageously, a trolley is immediately arranged with the loading platform empty space ready to house the chest which is being used, and an empty chest on another space of the loading platform so as to carry out the changeover immediately when the need arises.

The trolley with the full chest can be, for example, immediately replaced by another trolley with an empty chest. With that aim, two or more trolleys per casting machine can advantageously be envisaged, also to face the possibility that either a trolley or the chest arranged on it is inoperative, for example due to the loss of refractory. Alternatively, the trolley with a full chest can be taken immediately to an unloading place, and then immediately replaced in position beneath the casting machine.

The time in which a chest is filled with casting wastes can be of the order of 5–10 min. The changeover operation described in general can require times of less than 3 min., for example around 1 min.

The device previously described is susceptible of numerous modifications without departing from the scope of the present invention.

The invention claimed is:

1. A continuous metallic strip casting plant (N) comprising an ingot mould (1), a device for the evacuation of casting wastes comprising in its turn a trolley (5) supplied with at least one chest (4*b*) to contain wastes and metallic scrap, suitable to move and to be positioned below said ingot mould, wherein said trolley has dimensions such as to house at least two chests (4*a*, 4*b*) next to each other.

2. The plant according to claim 1, wherein said chests have the opening formed so as to be suitable for sealing with the aperture of a inert chamber (3) below the ingot mould crossed by a cast strip to define an area non-communicating with the outside environment.

3. The plant according to claim 2, wherein lifting means (7) are provided, said lifting means being placed below said ingot mould and suitable for raising from and for replacing on said trolley (5) at least one of said chests (4*a*, 4*b*).

4. The plant according to claim 3, wherein said trolley (5) can house at least three chests simultaneously.

5. An evacuation method of metallic waste from a continuous metallic strip casting plant according to claim 1, said method comprising the following steps:

a) filling a first chest (4*a*) of waste, fixed to an aperture in the lower part of an inert chamber (3) located beneath the ingot mould of said casting plant;

b) positioning a trolley (5) having a free chest housing (60) vertically underneath said first chest (4*a*) and a second housing occupied by a second chest (4*b*);

c) depositing said first chest (4*a*) with appropriate loading/unloading means (7) into said free chest housing of said trolley (5);

d) moving said trolley (5) so as to arrange said second chest (4*b*) underneath said aperture of the lower part of the inert chamber (3);

e) gripping said second chest (4*b*) with the appropriate loading/unloading means (7) and raising it to said aperture in the lower part of the inert chamber (3).

6. The method according to claim 5 further comprising a step of removing of the trolley (5) with said first chest (4*a*) of waste for further treatment of the wastes.

7. The method according to claims 6, comprising a step of introducing an inert gas into said inert chamber (3) during the chest changeover steps.

* * * * *